US007964134B2

(12) United States Patent
Wilkinson

(10) Patent No.: US 7,964,134 B2
(45) Date of Patent: Jun. 21, 2011

(54) PROCESS FOR PREPARING SUPERIOR CARBON FIBER

(75) Inventor: W. Kenneth Wilkinson, Waynesboro, VA (US)

(73) Assignee: International Fibers, Ltd., Fairfax, VA (US)

( * ) Notice: Subject to any disclaimer, the term of this patent is extended or adjusted under 35 U.S.C. 154(b) by 500 days.

(21) Appl. No.: 12/073,376

(22) Filed: Mar. 5, 2008

(65) Prior Publication Data

US 2009/0224420 A1 Sep. 10, 2009

(51) Int. Cl.
*B29C 71/02* (2006.01)
*D01D 10/02* (2006.01)
*D01D 10/04* (2006.01)

(52) U.S. Cl. ..... 264/342 RE

(58) Field of Classification Search ..... 264/29.2, 264/182, 210.7, 210.8, 211.15, 211.17, 342 RE
See application file for complete search history.

(56) References Cited

U.S. PATENT DOCUMENTS

| | | | | |
|---|---|---|---|---|
| 3,296,341 | A * | 1/1967 | Briar et al. | 264/182 X |
| 3,944,386 | A | 3/1976 | Wilkinson | |
| 3,965,227 | A * | 6/1976 | Stoy et al. | 264/182 X |
| 4,336,022 | A | 6/1982 | Lynch | |
| 4,585,844 | A | 4/1986 | Wilkinson | |
| 4,698,413 | A | 10/1987 | Lynch | |
| 5,364,581 | A | 11/1994 | Wilkinson | |
| 5,523,366 | A | 6/1996 | Wilkinson | |
| 5,616,292 | A | 4/1997 | Wilkinson | |
| 5,616,675 | A | 4/1997 | Wilkinson | |
| 5,708,111 | A | 1/1998 | Wilkinson | |
| 5,804,108 | A | 9/1998 | Wilkinson | |
| 6,054,214 | A | 4/2000 | Wilkinson | |
| 7,015,299 | B2 | 3/2006 | Wilkinson | |
| 2006/0134413 | A1 | 6/2006 | Wilkinson | |

* cited by examiner

*Primary Examiner* — Leo B Tentoni

(57) ABSTRACT

A process for preparing superior carbon fiber including a step of rapid imbibation of densification activator from an aqueous bath; and product prepared therefrom.

2 Claims, 2 Drawing Sheets

PROCESS FOR PREPARING SUPERIOR CARBON FIBER

BACKGROUND OF THE INVENTION

The prior art methodology for the preparation of carbon fibers employs high heat and extended periods of time to obtain the final product. The final carbon fiber product in prior art methodology is often a flawed product that contains weak spots and micro-bubbles. This is because present processes cannot control rapid increase in heat due to heating above the fusion point of the fiber. The only prior art strategy to handle this problem is to increase the temperature of the PAN (polyacrylonitrile) fiber to just below the fusion point of the copolymer fiber, and then to SLOWLY heat the fiber for an extended period of time; thus avoiding "burn out" of the fiber. The fiber employed in prior art processes does not begin to cross-link until late in the heating cycle (near the fusion point of the fiber). "Burn out" of the fiber occurs when the temperature of the fiber reaches the fusion point. The internal temperature of the fiber shoots up to 400 degrees C. and above. The result is that the fiber is destroyed. Thus, the prior art methods depend on slowing down the heating process, and then slowly raising the temperature over the next couple of hours.

A prior art process for preparing carbon fiber includes the use of three to four monomers. The monomers can be: acrylonitrile (90-98% by wt.), itaconic acid (2-10% by weight), ethyl acrylate (2-5% by wt.), and vinyl sulfonic acid (1-3% by weight). In a first step, the four monomers are polymerized as by a precipitation polymerization process in the presence of a Redox catalyst. The resultant polyacrylonitrile copolymer is then wet spun into fibers. The fibers have a density of about 1.2 grams/cc. The PAN (polyacrylonitrile) fibers are then removed to a first oxidation zone. The fibers are SLOWLY heated in an energy intensive process for a time of about 3-4 hours. The process must be carefully monitored to prevent runaway heating from the interior of the fibers.

PANOX (oxidized polyacrylonitrile) fibers are withdrawn from the first oxidation zone. The density of the PANOX fibers is about 1.4 grams/cc. The PANOX fibers can be used in areas of technology such as sporting equipment and the like. If pure carbon fibers are desired, the PANOX fibers are removed to a second oxidation zone which is a high temperature carbonization unit. Temperatures in the carbonization unit are from 1000-2000 degrees C., or even higher. All atoms other than carbon are vaporized away from the fibers to obtain a pure carbon fiber.

U.S. Pat. No. 5,462,799 discloses the preparation of a carbon fiber wherein a precursor PAN-fiber is oxidized, carbonized and if necessary graphitized to make the carbon fiber of specified surface oxygen concentration, specified surface concentration of hydroxyl groups and specified surface concentration of carboxyl groups.

U.S. Pat. No. 5,281,477 discloses the preparation of a carbon fiber having high tenacity and high modulus of elasticity. Pretreated fibers are passed through a first carbonization zone, a second carbonization zone and a third carbonization zone.

The problems of the current methodology for preparation of carbon fiber are, among others, as follows: (1) failure to recognize the fact that amidines are the true catalysts in the preparation of carbon fiber; (2) failure to recognize that metal ions "poison" the fiber at every step of the process; and must be substantially eliminated, (3) failure to recognize that the first oxidation step can be performed in a substantially reduced time frame, thus saving a considerable amount of energy.

Therefore there is a need for a process of preparing superior carbon fiber that overcomes the drawbacks of the prior art.

SUMMARY OF THE INVENTION

The present invention relates to an improvement in the process for preparing carbon fiber in accordance with the disclosures found in U.S. Pat. No. 5,804,108; issued to Wilkinson; U.S. Pat. No. 6,054,214, issued to Wilkinson, and US Patent Application Publication 2006/0134413, submitted by Wilkinson. All three references are incorporated in their entirety herein by reference. The disclosures of the '108, '214 patent and the '413 published application, rely on the preparation of a uniquely balanced polymeric precursor in order to achieve a carbon fiber precursor (a densified PAN fiber) that has superior modulus when compared with prior art carbon fiber. It is estimated that the modulus is improved by at least 2½ times when compared with prior art PANOX fibers.

The present invention relates to a process for producing a high quality carbon fiber. More specifically the invention relates to a rapid densification step for improving the efficiency and economics of carbon fiber production. As hereinafter disclosed, improved PAN-fiber (an activator-loaded PAN fiber) allows for rapid densification of said fiber. Temperature surges within the fiber are minimized, and heat release is spread over a longer time. The improvement of the present invention comprises a novel addition of an activator in an appropriate position on the PAN copolymer after spinning of the fiber.

The present process can result in a high net profit to a company because there is little waste (poor fiber quality in the current methodology means wasted money) and high efficiency. The carbon fiber prepared according to the present process is 30-40% more economical than the current methodology.

DETAILED DESCRIPTION OF THE INVENTION

Figure 1:
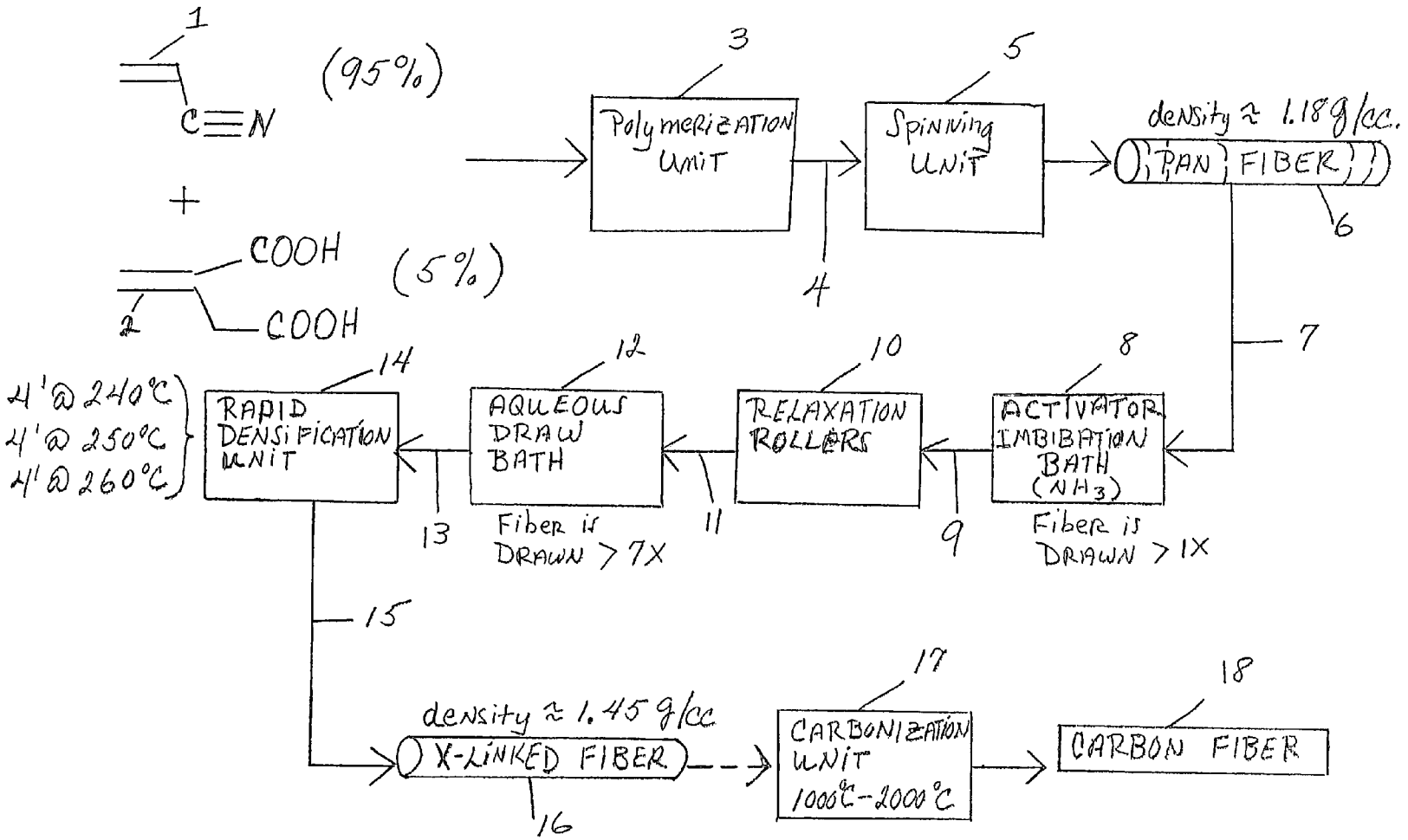
FIG. 1 is a flow diagram of an apparatus in block form showing the process for preparing carbon fiber according to the disclosures of the present invention.

The present process is superior to the most advanced process for preparing carbon fibers. It overcomes all of the failures of the prior art methodology as currently practiced today. In a preferred embodiment, two monomers comprising acrylonitrile (95% by wt.) and itaconic acid (5% by wt.) are added to a precipitation polymerization reactor along with a redox catalyst. No metal-containing or metal ion-containing solvents are employed. No vinyl sulfonic acid monomers are employed. DMF (dimethyl formamide) and DMAC (dimethylacetamide) are the preferred solvents. A polyacrylonitrile copolymer is removed from the polymerization reactor and added to a wet spinning zone for spinning into PAN fibers. The PAN fibers have a density of about 1.18 grams/cc. The wet spun PAN fibers are then added to an activator imbibation bath containing water and about 5% to about 10% by volume ammonia. The temperature of the bath is maintained at about 60 degrees C. While in the bath, the fibers are stretched at least about 1.5× to about 3× to allow the ammonia activator to penetrate into the fibers in a substantially uniform fashion. The penetration occurs in about 5 milliseconds. After removal from the activator imbibation bath, the activated PAN fibers are passed over a set of relaxation rollers. At least about 10% relaxation of the activated PAN fibers is allowed. Relaxed fibers are withdrawn from the relaxation rollers and transferred to an aqueous draw bath maintained at a temperature of about 100 degrees C. Once in the aqueous draw bath, the relaxed fibers are stretched again, this time at least about 7×. The drawing of the fiber in the aqueous draw bath allows for development of superior physical properties in the PAN fibers. In an alternative embodiment, the relaxed fibers are removed to a set of heated rolls for stretching. The rolls are maintained at a temperature of about 160 degrees C.

The next step in the process is an Infrared Analysis of the double drawn PAN fibers. A sample from the PAN fibers is removed to an IR Spectrophotometer for analysis. A first IR spectrograph is retained for future comparison.

The PAN fibers are then removed to a densification unit for rapid densification. Preferably, the fibers are heated for a time of about 12 minutes. The heating of the fibers is always below the fusion point of the PAN fiber. The heating begins at about 190-200 degrees C. and ends at about 400 degrees C. The preferred heating cycle is to heat the fibers at 240 degrees C. for four minutes, then to heat the same fibers at 250 degrees C. for four minutes, and finally to heat the same fibers at 260 degrees C. for another four minutes. A densified fiber, similar to a PANOX fiber, is then removed from the densification unit. The fiber has a density of about 1.4 grams/cc. to about 1.5 grams/cc. Density is a good measure of when the amount of volatile components is low enough so that the fiber will not burst into flames when it is heated to high temperatures of about 1000° C. to about 2000° C. Amidines are formed all along the carbon-carbon backbone of the polymer structure when ammonia activator attacks the pendant cyano groups during the heating of the fiber above about 160° C. All of the amidine groups are pure, in contrast with mixtures that are formed upon simple oxidation in an atmosphere containing ammonia (prior art). In the present inventive process, the in situ formation of amidines and subsequent densification of the fiber can be performed in an inert environment in the absence of oxygen.

The next step in the process is to obtain a second IR spectrograph. It is then compared to the first IR spectrograph. If the nitrile absorbance is reduced by about 15-25%, then the densified fibers are suitable for carbonization. If the nitrile absorbance is reduced by less than about 15% or increased by more than about 25%, then the densified fibers are discarded. Rather than discarding the densified fibers that are not suitable for carbonization, said fibers can be employed for uses that do not demand maximum stiffness.

Densified fibers suitable for carbonization are then removed to a carbonization unit for high temperature carbonization at a temperature of about 1000-2000 degrees C. Superior carbon fibers are then recovered from the carbonization unit. The superior carbon fibers have high tensile strength, high rigidity and a homogeneous structure with substantially no defects.

The present invention results in a high net profit to a company because the process has little waste (poor fiber quality in the current methodology means wasted money) and high efficiency.

The fiber is prepared from a mixture of comonomers, the mixture containing acrylonitrile monomer in an amount of about 95% by weight, and itaconic acid in an amount of about 5% by weight. The PAN copolymer fiber has been treated by immersion in an aqueous activator imbibation bath containing an excess of ammonia. By "excess ammonia" is meant that there is more than enough ammonia present in the aqueous bath to react with all of the pendant carboxylic acid groups present in the PAN copolymer. The bath is maintained at a temperature of about 50° C. to 70° C. While being immersed in the bath, the fiber is drawn about 1.5× to about 3× to allow ammonia activator to penetrate into the central regions of the fiber. The drawn fiber is imbibed with activator in a time of about five milliseconds, the activator being homogeneously dispersed throughout the cross-section of the fiber. In prior art methods, activator remains on or near the surface of the fiber, with possibly a minor amount of activator penetrating to the core of the fiber.

Double drawn and activated PAN fiber can readily be removed to a carbonization unit for burning off all extraneous atoms (other than carbon). A superior carbon fiber with improved physicals is obtained.

FIG. 1 relates to a flow diagram of an apparatus and process for preparing carbon fiber according to the present invention. Acrylonitrile monomer 1 and itaconic acid monomer 2 are added to a polymerization unit 3. Acrylonitrile is present in an amount of about 95% by weight, and itaconic acid is present in an amount of about 5% by weight. The monomers are mixed in a solvent such as DMF (dimethylformamide) and a catalyst mixture such as ammonium persulfate and ammonium bisulfite; and a minor amount of iron catalyst. Monomers are polymerized in the polymerization unit to obtain a polyacrylonitrile copolymer. The copolymer is removed from the polymerization unit. It is then transferred to a spinning unit 5 as by first transfer means 4. In a preferred embodiment, the spinning unit 5 is a wet spinning unit. Wet spinning allows formation of filament having a substantially circular cross-section. Dry spinning gives a dog-bone shaped cross-section for the filament.

Spun fiber 6 is removed from the spinning unit 5, and enters the activator inbibation bath 8. Second transfer means 7 removes the spun PAN fiber having a density of about 1.18 g/cc. from the spinning unit to the activator inbibation bath 8. The activator imbibation bath 8 comprises an aqueous solution of ammonia. The ammonia activator is present in the solution in an amount substantially sufficient to react with all of the carboxylic acid groups in the PAN fiber. The carboxylic acid groups are a result of the itaconic acid monomer used in the polymerization reaction. When the spun fiber 6 is in the activator imbibation bath 8, it is stretched at least about 1.5× up to about 4×. Stretching of the fiber 6 allows micro-cracks to develop in the surface of the PAN fiber 6. Once micro-cracks are developed, activator rushes into the interior of the fiber 6 in less than 5 milliseconds.

Activated PAN fiber is then removed from the activator imbibation bath 8 as by a third transfer means 9, and added to a set of relaxation rolls 10 in order to relax the activated PAN fiber. Activated PAN fiber is relaxed at least about 8% to about 12%. Preferably, the PAN fiber is relaxed about 10% on the set of relaxation rolls 10. A fourth transfer means 11 receives the relaxed PAN fiber and removes it to an aqueous draw bath 12. While immersed in the aqueous draw bath 12, the activated and relaxed PAN fiber is again drawn, this time at least about 7× to set the physical properties of the fiber.

The double drawn PAN fiber, imbibed with activator, is removed as by fourth transfer means 13 to a rapid densification unit 14. In a preferred embodiment, the rapid densification unit 14 comprises a set of three densification rolls (not shown). A first densification roll is maintained at a temperature of about 240 degrees C. The double drawn PAN fiber remains on the first densification roll for a time of about 4 minutes. It is then removed to a second densification roll that is maintained at a temperature of about 250 degrees C. The double drawn PAN fiber remains on the second densification roll for a time of about four minutes. It is then removed to a third densification roll that is maintained at a temperature of about 260 degrees C. The double drawn PAN fiber remains on the third densification roll for a time of about four minutes. Thus, the total amount of time that the PAN fiber remains in the rapid densification unit 14 is about twelve minutes. A densified PAN fiber 16, similar to prior art PANOX fiber, is removed from the densification unit 14. Densified PAN fiber 16 can be employed in any technological area that is presently inhabited by PANOX fiber.

After removal from the third densification roll, the densified PAN fiber 16 is removed as by fifth transfer means 15 to a carbonization unit 17. Once in the carbonization unit 17, the densified PAN fiber 16 is converted in an inert atmosphere to pure carbon fiber 18 that contains only carbon atoms. The conversion temperatures are about 1000 to about 2000 degrees C.

Figure 2:
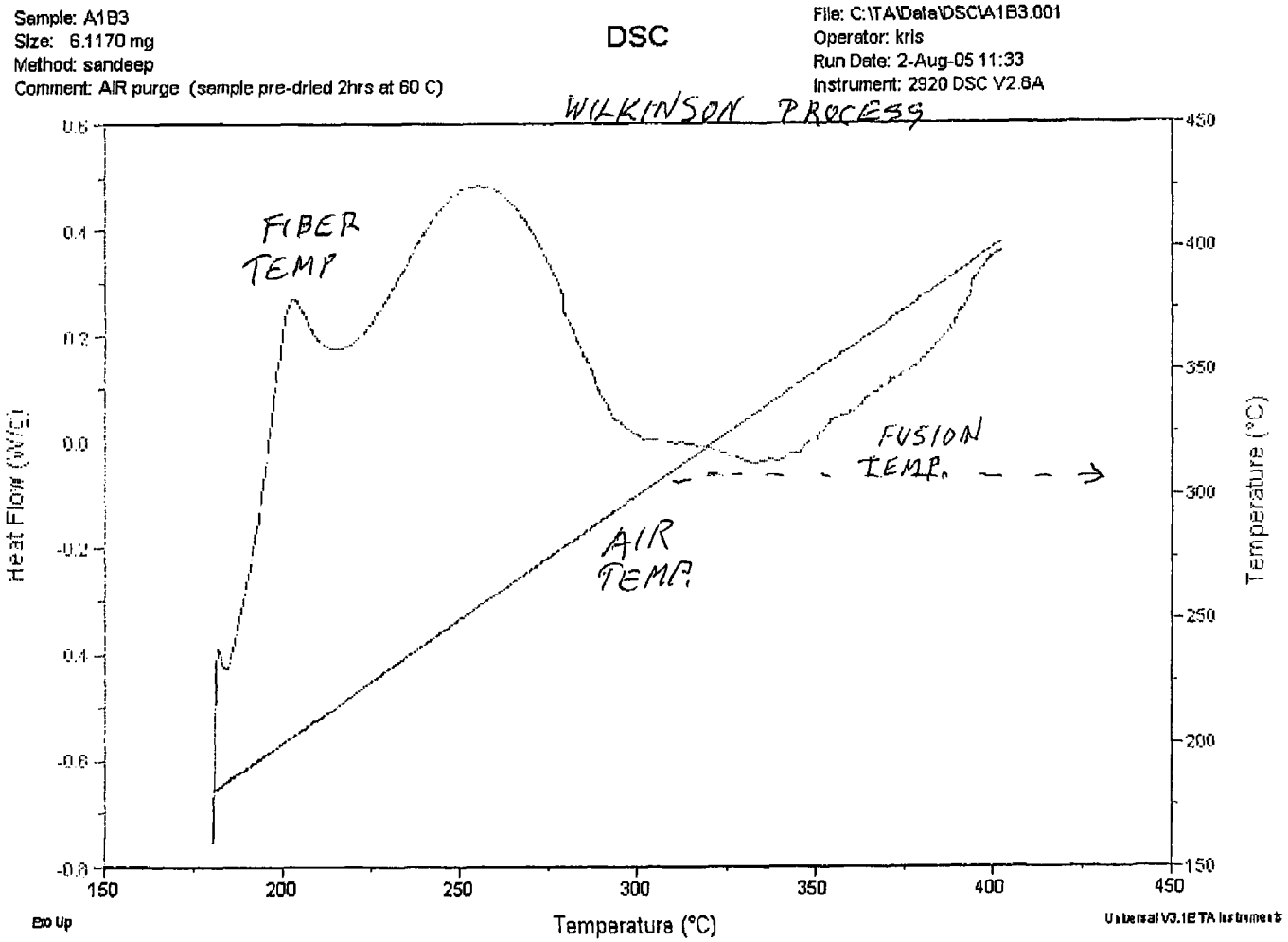
FIG. 2 is a graphical representation of a DSC (differential scanning calorimetry) curve for an activator-imbibed PAN fiber prepared according to the presently disclosed invention.

FIG. 2 displays a graph of a DSC curve that shows crosslinking, and hence densification, of the fiber to be complete before the copolymer begins to melt. The programmed heating allows maximum heat dissipation without destruction of the fiber. The modulus of the crosslinked (densified) PAN fiber is about two and one-half times better than the modulus of prior art PANOX fibers (oxidized polyacrylonitrile fibers).

The DSC curve is obtained by programmed heating of the treated PAN fiber which is a fiber loaded with ammonia activator. Upon heating of the fiber, ammonia is released from the salt form and begins to react with the pendant cyano groups of the copolymer to form cross-links that are ladder-like. Ultimately, arnidine groups are generated to obtain a ladder-like structure. Amidine groups are the true catalysts in the formation of densified PAN fiber. Programmed heating of the treated PAN fiber is conducted by increasing the temperature at a rate of five degrees per minute. The heating is concluded in about twenty minutes. Onset of the peak that represents densification of the fiber is about 183.9 degrees C. The maximum temperature of the heat release is about 256 degrees C. The total peak area is about 631 Joules per gram. The percentage of the peak area that is greater than 270 degrees C. is about 80%. The DSC curve shows that all of the heat of the fiber has been dissipated before the melting point of the fiber became the dissipation start at a lower temperature.

Fibers or filaments (or tows) that have a density of less than about 1.4 g/cc. cannot be carbonized to obtain carbon fiber because they will undergo a "flame-out" at higher temperatures such as 1000 degrees C. This is due to the volatiles that remain in the fiber or filament (or tow).

The present invention provides for a polymeric precursor fiber or filament that does not undergo "flame-out" at carbonizing temperatures. Precursor fibers or filaments of the present invention also have an improved modulus, the modulus being up to 21/2 times higher than the modulus of prior art PANOX fibers. This is because there is less oxidative degradation of the filament or fiber during the heating cycle. As noted heat release begins at a much lower temperature than in the prior art. The internal heat of the filament or fiber is released over a wide range of about 100 degrees of heating. The heat release is also conducted over a substantially longer time interval. The internal heat of the filament or fiber, generated because of chemical cross-linking reactions, is removed in about 15 minutes rather than a spike of 3 seconds. The densification step is therefore conducted about three to five times faster than prior art methods of oxidatively preparing PANOX fibers.

In the present invention, the balancing begins with the first step of the carbon fiber process, the first step being the polymerization of monomers. In a preferred embodiment, monomers chosen for polymerization are acrylonitrile and itaconic acid. The itaconic acid is present in an amount of about 2% by weight to about 8% by weight. Preferably, the amount of itaconic acid is about 5% by weight. Itaconic acid is a dicarboxylic acid, and therefore supplies twice as many anchors for retaining amine (or ammonia) catalyst as does (meth) acrylic acid and the like. Most preferably, monomers are present in the following amounts: 95% by weight acrylonitrile and 5% by weight itaconic acid. The monomers are polymerized as by a polymerization reaction such as precipitation polymerization or solution polymerization. Most preferably, a precipitation polymerization reaction in aqueous phase is employed. The precipitation polymerization is conducted in the presence of a catalyst regime comprising ammonium persulfate, potassium persulfate ammonium and about 10 ppm iron persulfate. The amount of iron catalyst is kept at a minimum to avoid polymer degradation. An azo initiator is employed based on the total amount of ingredients. The reaction is conducted at a temperature of about 60 degrees C. to about 80 degrees C. An aluminum shell reactor containing a water jacket shell can be employed.

If a solution polymerization reaction is employed, the catalysts used are: DMAC, an azo initiator and ferrous ammonium sulfate. The reaction is conducted at a temperature of about 60 degrees C. to about 80 degrees C. The reaction is conducted for a time of about 20 minutes to about 90 minutes. Preferably, the reaction is conducted for a time of about 60 minutes.

When the precipitation polymerization reaction is complete, the reaction mixture is filtered to remove water. A polyacrylonitrile (PAN) copolymer is recovered from the filtration process. A filter cake is formed. The filter cake is re-slurried in water. The water is removed as by decantation or the like. The copolymer is dried to a powder in a drying unit. Preferably, the dry powder is obtained by dropping copolymer noodles onto a porous moving belt. Hot air passing through the belt dries the noodles of copolymer. Noodles are then pulverized to obtain the dry powder.

A mixer can be employed to form a spin dope. Preferably, the spin dope formation unit is a MARCO MIXER. The acrylonitrile dry powder is added to the MARCO MIXER, along with dimethylformamide (DMF), which is sprayed into the mixer. The mixer is heated to a temperature of about 60 degrees C. to about 100 degrees C. A mixture of acrylonitrile copolymer and DMF is formed, the mixture having the consistency of honey. In an alternative embodiment, DMF can be replaced with DMAC (dimethylacetamide).

The mixture of acrylonitrile copolymer and DMAC (dimethylacetamide) is then removed to an extrusion unit. An aqueous bath of DMAC (or DMF) and copolymer is then formed. The aqueous bath, called a coagulation bath, is maintained at a temperature of about 25 degrees C. to about 50 degrees C. Fine filaments of copolymer are extruded from the coagulation bath. The extrusion unit can be a dry spinning operation or a wet spinning operation. Preferably, a conventional wet spinning apparatus is employed. Any metal-containing, or metal ion-containing, solvents are avoided. Wet spinning of the spin dope allows formation of a gel filament that has a substantially circular cross-section. Dry spinning is not preferred because it produces filaments having a dog-bone-shaped cross section.

Filaments from the extrusion unit are pulled together into a filament bundle. Large tows can be prepared from the filaments, if desired.

A filament bundle is removed to a wet trough and then to a water wash tank. Preferably, the water wash tank can contain about 20% DMF or DMAC. The bundle is then removed from the water wash tank and transferred over a set of forwarding rolls to an aqueous activator imbibation bath. The activator imbibation bath contains an activator which is a member selected from the group consisting of a low molecular weight primary amine, a low molecular weight secondary amine and ammonia. By "low molecular weight" is meant a C1 to C6 aliphatic group. Preferably, ammonia is the activator. The ammonia is present in the activator imbibation bath in an amount of about 1% by volume to about 5% by volume. Ammonia activator must be present in the activator imbibation bath in an amount sufficient to neutralize all of the carboxylic acid groups present in the acrylonitrile copolymer. The carboxylic acid groups are due to the presence of the itaconic acid monomer in the copolymer. The activator imbibation bath is an aqueous bath that contains activator. The bath is maintained at a temperature of about 50 degrees C. to about 70 degrees C. The speed of the filament bundle (or tow) traveling through the activator imbibation bath is about five yards per minute to about two hundred yards per minute. Speeds are adjusted to obtain optimum results. The activator imbibation bath is similar to the dye bath apparatus and process disclosed and claimed in U.S. Pat. No. 3,944,386, issued to Wilkinson, herein incorporated by reference.

While immersed in the activator imbibation bath, the filament bundle of acrylonitrile copolymer is drawn at least about 1.5× to about 3×. This stretching of the filament bundle allows the aqueous solution, containing ammonia activator, to penetrate the filaments down to the core of the filament in less than about five milliseconds. In a preferred embodiment, the draw ratio of the filament bundle is 2×. Activator becomes entrained in the fiber as by "imbibation" to obtain a gel polyacrylonitrile fiber "loaded" with activator in a substantially homogeneous manner. The aqueous ammonia bath uniformly penetrates the gel state of the filament and allows the ammonia activator to form a salt with the carboxylic acid groups of the itaconic acid present in the copolymer. The amount of itaconic acid (or the like) in the copolymer determines the amount of activator (ammonia) "imbibed" into the filaments. Drawing of the filament bundle allows the activator to penetrate the outer skin of the filaments through microcracks generated by the stretching of the filament bundle. The activator is homogeneously dispersed in each filament.

The ammonium (or amine) salt remains unreacted and uniformly dispersed on a molecular basis until the filament is heated to a temperature of about 160 degrees to about 200 degrees C. It is within the scope of the present invention to employ larger tows than normal. This is because drawing of the fiber, while immersed in the activator imbibation bath, readily allows placement of ammonia (or amine) activator homogeneously throughout the tows.

The drawn filament bundle (or tow) is removed from the activator imbibation bath, and conducted to a series of relaxation rollers. The relaxation rollers are maintained at a temperature of about 100 degrees C. The drawn filament bundle (or tow) is relaxed as it passes over the heated relaxation rollers. Preferably, the relaxation of the drawn bundle is about 8% to about 12%. Most preferably, the drawn filament bundle is relaxed about 10%. This procedure allows the micro-cracks on the surface of the filaments to close. Preferably, the rollers are coated with water. The water steams the filaments as the temperature of the forward rollers reaches 100 degrees C.

The relaxed filament bundle then enters an aqueous draw bath that is maintained at a temperature of about 100 degrees C. While immersed in the aqueous draw bath, the filament bundle is again drawn. The preferred draw ratio for the bundle is about 7× to about 10×. Physical properties of the filaments are developed at this stage.

In an alternative embodiment, the relaxed filament bundle does not enter an aqueous draw bath, but rather is conducted to a heated draw roll. The draw roll is heated to about 160 degrees C. While on the heated roll, the filament bundle is drawn at a draw ratio of about 7× to about 10× to develop the physical properties.

Whether the filament bundle of acrylonitrile copolymer, imbibed with activator, comes from the aqueous draw bath or the heated draw roll, it is now in condition for densification. The density of the filament bundle is increased from about 1.18 grams per cc. to about 1.40 grams per cc in a rapid densification unit. This is enough cross-linking to prevent escape of gases when the bundle is heated to very high temperatures in a carbonization unit. Prior art methods heat the filament bundle to just below the fusion point of the copolymer in order to begin cross-linking. Then, to avoid "burn out" of the filament bundle, the prior art methods slow down the heating process. This approach requires heating the filament bundle in an oxidation unit for a time of about 3-4 hours.

The present process does not need to employ oxygen or air. Densification of the filament bundle obtained by the present process can be performed in the absence of air or oxygen. It is usually not required to exclude air, and that does not have to be done. The theory is that oxygen does not cause the crosslinking of the filaments, but rather that the ammonia activator, upon gentle heating, forms amidine moieties within the polyacrylonitrile copolymer. The amidine moieties then are the true catalyst that causes densification of the filament.

Because the amine activator (preferably ammonia) is homogeneously dispersed throughout each filament of the filament bundle, it is quite easy for the bundle to be heated in a short heating cycle, all the while keeping the temperature below the fusion point of the filament.

The thus prepared filament bundles, imbibed with activator, can be densified in a standard oven by heating for a time of about 8 minutes to about 15 minutes. The temperature at the start of the densification process is set at about 190-200 degrees C. The final temperature at the end of the short heating cycle is about 400 degrees C.

In an alternative embodiment, the filament bundle can be densified in a unique rapid densification unit comprising a set of three densification rolls. The set of rolls comprises a first densification roll, a second densification roll and a third densification roll. The filament bundle passes over the first densification roll which is operated at a temperature of about 240 degrees C. to begin the densification process. This temperature is well below the fusion point of the polyacrylonitrile copolymer. Time of treatment on the first densification roll is about three minutes to about six minutes. Preferably, the time of treatment is four minutes. After removal from the first densification roll, the filament bundle is taken up by the second densification roll. The roll is operated at a temperature of about 250 degrees C. Time of treatment on the second densification roll is about three minutes to about six minutes. Preferably, the time of treatment is four minutes. The filament bundle is then removed from the second densification roll, and transferred to the third densification roll. The third roll is maintained at a temperature of about 260 degrees C. Time of treatment on the third roll is about three minutes to about six minutes. Preferably, the time of treatment is four minutes.

After removal from the set of three densification rolls (the densification unit), the filament bundle has a density of about 1.4 to about 1.5 grams per cc. Prior to removal to the rapid densification unit, the filament bundle had a density of about 1.18 grams per cc. The densified filament bundle can be employed in any and all areas of technology where PANOX fibers are presently utilized.

In an alternative embodiment, the densified filament bundle is removed to a carbonization unit where it is carbonized in an inert atmosphere (eg., nitrogen gas) to obtain superior carbon fiber. The temperature of the carbonization unit is maintained at about 1800 degrees C. to about 4000 degrees C. Preferably, the temperature is about 2000 degrees C. Density of the carbon fiber is about 1.78 grams per cc. to about 1.8 grams per cc. Carbonization is completed in about two minutes.

Carbon fibers prepared from acrylonitrile copolymers by the rapid densification process of the present invention have superior physical properties such as increased modulus. The fibers are useful as reinforcement materials in automobile, aerospace, recreational and various other industries. An increasing demand for strong lightweight materials insures an expanded use of carbon fibers in the future. Thus a need exists for a process which insures that the starting materials for producing carbon fibers are of the finest quality. A fine quality acrylonitrile copolymer has no defects such as voids formed when gases are expelled during fiber preparation. Also the fiber should not contain more than traces of metal contaminants, as these tend to degrade the fiber. The fiber should have a round shape for maximum stiffness.

Carbon fibers, which have heretofore been used as reinforcing material for plastic composite compositions, are preferably characterized by high tensile strength, high rigidity and a homogeneous fibrous structure. These characteristics can be adversely affected by certain properties found in the acrylonitrile copolymer feedstocks. If these undesirable properties can be identified and removed, then the final carbon fiber product is greatly enhanced in desirable characteristics.

The objective of the densification step in the preparation of carbon fibers is to increase the density of the fiber to about 1.4 g/cc. The PAN-fiber, prior to densification, has a density of about 1.18 g/cc. If the carbonization step, which is conducted at temperatures of about 1000.degrees C. to 2000.degrees C., is performed on fiber having a density below about 1.4 g/cc., then bubble defects are present due to volatile components. Two factors that contribute to increase in density of the fiber during the densification step are: removal of volatile components and crosslinking of the polyacrylonitrile polymer.

A requirement for a more efficient densification step in the process for preparing carbon fibers is the formation of crosslinks in the precursor polyacrylonitrile copolymer. The sticking temperature of the copolymer is raised in proportion to the number of crosslinks formed in the copolymer. Broadly, the sticking temperature of polymer particles in a fluidized bed is defined as the temperature at which fluidization ceases due to agglomerization of the particles in the bed. A polymer can be inherently sticky due to its chemical or mechanical properties or pass through a sticky phase during the production cycle. The flow factor references the flow of all materials to that of dry sand. On a scale of 1 to 10, dry sand scores a 10. Sticky polymers are usually 1-3, and free flowing polymers are usually 4-10.

In the present invention, effective cross-links are obtained by the use of ammonia. Prior art processes employ air in an oxidation step. The air degrades the polyacrylonitrile copolymer to give mixtures of amines. These amines cause formation of amidines by reactions with cyano groups on the copolymer. However, the non-homogeneous mixture of amines causes formation of non-homogeneous crosslinks. Non-homogeneous cross-links cause uneven physical properties throughout the fiber or filament. The use of ammonia as sole activator prevents formation of non-homogeneous crosslinks.

Increased amounts of carboxylic acid groups in the PAN copolymer allows for retention of more ammonia activator. An advantage of the ammonia is that it eaves no residue upon cross-linking. Cross-linking agents containing metal cations such as sodium, potassium or zinc leave a residue after reaction. Fibers cross-linked in the presence of ammonium ion reach an end point density of 1.4 g/cc more quickly than fibers cross-linked in the presence of sodium ions. Also, fibers prepared from copolymers devoid of neutral monomers such as methyl methacrylate are more readily crosslinked. Increase in density depends upon amount of ammonium ion present and surface area of the fiber. A fiber with a large surface area is much more difficult to crosslink.

Once the fusion point of the copolymer is reached (about 280.degrees C), heat release of the copolymer skyrockets to extremely high exothermic conditions. Rapid release of volatiles leads to poor physical properties in the carbon fiber product. If there is a relatively low amount of ammonium ion retained by the copolymer, heat release of the copolymer climbs rapidly to high exothermic conditions once the fusion temperature is reached.

EXAMPLE

Into a round bottom 1000 ml flask, equipped with a magnetic stirrer, is added 500 ml distilled water. Then acrylonitrile in an amount of 1,235 g (23.3 moles) is added to the water. Itaconic acid in an amount of 65 g (0.5 moles) is then added to the water solvent. A catalytic amount of ammonium persulfate and potassium bisulfite is then added to the aqueous solvent. A micro-amount of catalytic iron (about 10 ppm) is also added to the aqueous solvent.

The aqueous mixture of acrylonitrile, itaconic acid, ammonium bisulfite, potassium persulfate, and iron is stirred for about 15 minutes. The stirred solution is then removed to an aluminum shell reactor, the reactor surrounded by a water-jacket shell. The reactor is heated to about 80° C. for a time of about 30 minutes. A copolymer of acrylonitrile and itaconic acid is formed as by a precipitation polymerization. Heat of reaction is controlled by the water jacket shell.

After the precipitation polymerization reaction is complete, the aqueous dispersion of PAN copolymer is removed from the reaction mixture as by filtration. A filter cake comprising the PAN copolymer is formed.

The filter cake is re-slurried in distilled water. The water is then decanted off. The PAN copolymer is then dried to a powder in a drying unit.

Powder of PAN copolymer is added to a MARCO MIXER, along with dimethylformamide (DMF) which is sprayed into the mixer. Mixing begins, as the temperature is increased to 100° C. The mixture of copolymer and DMF is continuously mixed for about 1 hour.

After an hour, the coagulation bath of PAN and DMF has a consistency of honey. The coagulation bath is transferred to a wet spinning unit for extrusion into filaments. The wet spinning operation is conducted at a temperature of about 50° C. Fine gel filaments of PAN copolymer are obtained from the wet spinning unit.

Filaments are then gathered together to form bundles. Thus, formed filament bundles are transferred to a wet trough comprising water. After removal from the wet trough, filament bundles are added to a water wash tank containing an aqueous solution of DMF (20%).

Filament bundles are then removed from the water wash tank and taken up by rollers.

From the rollers, the filament bundles of PAN copolymer are removed to an activator bath containing an aqueous solution of ammonia. The ammonia is present in the aqueous bath in an amount of about 5% by volume. The activator bath is heated to a temperature of about 70° C. Filament bundles are passed through the bath at a speed of about 50 yards per minute. While immersed in the bath, the filament bundles are drawn about 2×. Ammonia activator is imbibed into each filament down to its core in a fraction of a second. All available carboxylic acid groups in the copolymer are tied up with ammonia, forming the ammonium salt of the organic acid.

The filament bundles, containing an "activated" PAN copolymer, imbibed with ammonia, are then withdrawn from the activator bath. Bundles are conducted to a set of relaxation rollers, operating at a temperature of about 100° C., and coated with water. As the bundles are steamed, they relax about 10%.

The filament bundles of "activated" PAN copolymer are withdrawn from the relaxation rollers, and removed to an aqueous draw bath. The aqueous bath is heated to a temperature of about 100° C. While immersed in the bath, the filament bundles are drawn 7×. The physical drawing develops the physical properties of the "activated" PAN copolymer.

The filament bundles are then withdrawn from the aqueous draw bath, and transferred to a rapid densification unit. The rapid densification unit comprises a set of three heated rollers. The first heated roller is set at a temperature of about 240° C. the second heated roller is set at a temperature of about 250° C. The third heated roller is set at a temperature of about 260° C. As the filament bundle passes over the three rollers at a speed of about 5 ypm (yards per minute), the imbibed ammonia activator is released from the carboxylic acid group of the itaconic acid. Upon release, the ammonia rapidly begins to cross-link the pan copolymer, forming both intramolecular and intermolecular cross-links. Amidine moieties are formed from cyano groups of the acrylonitrile. The density of the PAN copolymer increases to about 1.4 g/cc in a time of about 15 minutes. Modulus of the densified PAN copolymer is about 2.5 times higher than the modulus of prior art PANOX fibers.

While the invention has been described by specific examples and embodiments, there is no intent to limit the inventive concept except as set forth in the following claims.

I claim:

1. A process for preparing a densified PAN fiber, comprising the step of:

densifying a PAN fiber loaded with activator by heating said fiber in a rapid densification unit for a time of about 8 minutes to about 15 to 20 minutes to obtain the densified PAN fiber; wherein the rapid densification unit comprises a set of three densification rolls, wherein:

the three densification rolls comprise a first densification roll operated at a temperature of about 235° C. to about 245° C., a second densification roll operated at a temperature of about 245° C. to about 255 C., and a third densification roll operated at a temperature of about 255° C. to about 280° C.

2. A process according to claim 1, wherein:

the activator is ammonia.

* * * * *